US007225945B2

(12) United States Patent
Crider et al.

(10) Patent No.: US 7,225,945 B2
(45) **Date of Patent: *Jun. 5, 2007**

(54) SELF-ADJUSTING RE-SEALABLE SPRING CENTER CLOSURE

(75) Inventors: Matthew Crider, York, PA (US); Walt Herring, York, PA (US)

(73) Assignee: Graham Packaging Company, LP, York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/203,155

(22) Filed: Aug. 15, 2005

(65) Prior Publication Data

US 2005/0269328 A1 Dec. 8, 2005

Related U.S. Application Data

(63) Continuation of application No. 10/300,016, filed on Nov. 20, 2002, now Pat. No. 6,959,829.

(51) Int. Cl.
*B65D 17/04* (2006.01)

(52) U.S. Cl. ..... 220/276; 220/790

(58) Field of Classification Search ..... 220/276, 220/780–784, 790–794, 309.1, 309.2, 265, 220/266

See application file for complete search history.

(56) References Cited

U.S. PATENT DOCUMENTS 3,298,415 A * 1/1967 Klygis ..... 215/321
3,622,028 A * 11/1971 Lohrer ..... 215/253
3,840,144 A * 10/1974 Dry ..... 220/792
3,840,304 A 10/1974 Dry
3,853,237 A 12/1974 Marchant
3,934,745 A 1/1976 Lovell
3,977,563 A 8/1976 Holt
4,206,852 A * 6/1980 Dunn et al. ..... 215/252
4,256,240 A * 3/1981 Woinarski ..... 220/782
4,308,970 A * 1/1982 Von Holdt ..... 220/790
4,380,304 A 4/1983 Anderson
4,380,305 A * 4/1983 Von Holdt ..... 220/782
4,408,698 A 10/1983 Ballester
4,625,876 A 12/1986 Bullock, III
4,933,133 A 6/1990 Brown et al.
5,050,754 A 9/1991 Marino
5,373,955 A 12/1994 Marino
5,460,287 A * 10/1995 Cargile et al. ..... 220/276

* cited by examiner

*Primary Examiner*—Lien M. Ngo
(74) *Attorney, Agent, or Firm*—Venable LLP; James R. Burdett; Steven J. Schwarz

(57) ABSTRACT

The application is directed to a leak-resistant closure for a plastic container having a generally planar central portion a peripheral portion, and a spring structure. The peripheral portion defines an annular recess with an inner wall having a secondary sealing formation for engaging a free edge of a container The outer wall of the peripheral portion has a primary sealing formation on an inner surface thereof and faces the annular recess, thereby defining the primary sealing formation. The spring structure biases the peripheral portion radially outward from the central portion, and the spring structure is positioned between the central portion and the peripheral portion.

10 Claims, 4 Drawing Sheets

SELF-ADJUSTING RE-SEALABLE SPRING CENTER CLOSURE

CROSS REFERENCE TO RELATED APPLICATIONS

This application is a continuation of U.S. patent application Ser. No. 10/300,016, filed Nov. 20, 2002 now U.S. Pat. No. 6,959,829.

BACKGROUND OF THE INVENTION

1. Field of the Invention

The present invention relates to a plastic container and lid and, more particularly, to a lightweight easy on and off lid with a reusable liquid seal closure.

2. Related Art

Many food and beverage products sold to the consuming public are provided in wide mouth jar-like containers. Consumers have indicated that they prefer containers which initially have a tamper-evident seal, and which can be resealed after opening for partial consumption of the contents. It is imperative that any such container have a seal which is leak-resistant from the time the lid is applied until end use by the consumer.

While seal integrity is important, the lid should allow for easy removal by the consumer. Therefore, a commercially-desirable container should have a reliable seal and a lid that is easily removed, even if the container and its contents are frozen.

Conventional containers for frozen juice concentrate have been constructed with a cardboard sidewall and metallic end lids. This construction does not provide a container that is well suited for partial consumption of its contents and re-closure. Furthermore, removal of the lid from the frozen container is not always without difficulty.

With this in mind, containers made of plastic are well suited for frozen juice concentrates, and other consumer products. Plastic containers made from an injection-molded process could be used for this purpose, since their design provides precise manufacturing control of dimensions such as heights, depths, outside and inside diameters, wall thicknesses, etc. However, injection molded plastic containers are not currently being recycled and this is a major disadvantage of such containers. Blow molding processes for making plastic containers could be utilized, since such containers are easily recyclable. However, with blow molding techniques, dimensional tolerances are more difficult to control.

A problem associated with freezable blow-molded containers is the need to accommodate slight changes in configuration due to changes in volume as the liquid freezes after the container has been sealed with a lid. The container and lid seal must remain leak-resistant not only under these conditions, but also throughout transportation and display, up to final usage by the consumer.

Current container closures, such as described in U.S. Pat. No. 4,933,133, while sealing containers effectively, have several shortcomings. Current container closures for containers such as frozen juice bottles and cans are not re-sealable. If the consumer does not wish to use all of the product at once, he must devise his own method of closing the container. Home-made solutions are generally not sturdy enough to withstand being dropped.

Another shortcoming of current container closures is that they cannot adjust to variations in the length of a flange at the open end of the container, particularly when the container is manufactured by a blow molding process. The flange forms part of the seal of the closure and the container. These variations make it more difficult for the closure to achieve and maintain a consistent seal.

Current container closures accommodate tolerances by utilizing a relatively thick walled construction to apply pressure to the sides of the container and retain contact to ensure a tight seal. However, this added weight is large enough to slow down the injection cycle time. A slow injection cycle means that fewer closure units can be manufactured at a time, reducing the ability of the manufacturer to supply units for filling. Reducing the weight of the closure has the potential, however, to degrade performance under abuse, such as when the container is dropped.

Similarly, once the tamper-evident seal is removed, current containers suffer a large reduction in their ability to withstand abuse.

U.S. Pat. Ser. No. 5,460,287 ('287), incorporated herein by reference in its entirety, of common assignee, has some advantages over the prior art. The present invention further improves upon the features of '287.

OBJECTS OF THE INVENTION

A primary object of the present invention is to provide a novel multipurpose plastic container having an improved lid seal.

Another object of the present invention is to provide an improved container and lid combination that withstands the rigors of the filling and freezing processes, yet remains leak-resistant throughout normal handling of the container.

A further object of the present invention is to provide a tamper-evident plastic container and lid combination.

A still further object of the present invention is to provide a blow-molded wide mouth plastic container and injection-molded lid having a tamper-evident tear strip, which, after removal, enables the lid to be removed from the container and reapplied.

SUMMARY OF THE INVENTION

The present invention provides a lightweight re-usable liquid seal closure to reduce plastic weight in current packages. The present invention provides the consumer with an easy on and off removable lid that is reusable while still maintaining a consistent secondary seal.

The invention includes a leak-resistant plastic container and closure. The container has an open end; an inner periphery; an outer periphery; and a container flange extending around the inner periphery at the open end. The closure has a generally planar and circular inner lid; a spring extending around an outer circumference of the inner lid; an arcuate flange receptacle extending around an outer circumference of the closure at a circumference outside the spring, wherein the flange receptacle comprises an inner surface and an outer surface; a secondary sealing bead, positioned on the inner surface of said flange receptacle; and a primary sealing bead, positioned on an outer surface of the flange receptacle and opposite the secondary sealing bead; wherein the spring exerts a sealing pressure against the container flange when the closure is placed on the open end of the container.

The spring mechanism allows for a reduction in the weight of the lid by removing the need for further reinforcement to withstand abuse. This weight reduction is achieved by reducing the need for a rigid central planar region. Instead, the central planar region can be thinner, using less material, and less rigid. A weight reduction of up to about 32.4% can be achieved while still maintaining abuse standards. The spring design also adapts to the inconsistency of manufacturing of the container flange. For example, a container flange in a typical frozen juice package may vary by up to 0.03 inch. A variation of up to about 0.10 inch in flange length can be accommodated by the spring design lid of the present invention.

The container is particularly suited to be filled with a liquid initially in a cold state, sealed and subsequently frozen into a solid state. As the liquid takes on a solid form, its volume increases in the sealed container. As discussed heretofore, various plastic containers and lid designs that have been proposed have met with varying degrees of commercial success.

The present invention overcomes the limitations of prior art container and lid combinations by means of a novel container lid configuration described herein which cooperates with standard containers that are currently commercially available, to provide a commercially desirable container that can withstand the rigors of freezing, yet remain leak-resistant before and after opening, use and resealing by the consumer. The lid includes tamper-evidence band, and is easy to remove, even when the container and contents are still frozen. In addition, the container and lid allows the consumer to reapply the lid onto the container after partial withdrawal of the contained product, or for other purposes.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements. The left most digit in the corresponding reference number indicates the drawing in which an element first appears.

DETAILED DESCRIPTION OF AN EXEMPLARY EMBODIMENT OF THE PRESENT INVENTION

Figure 1:
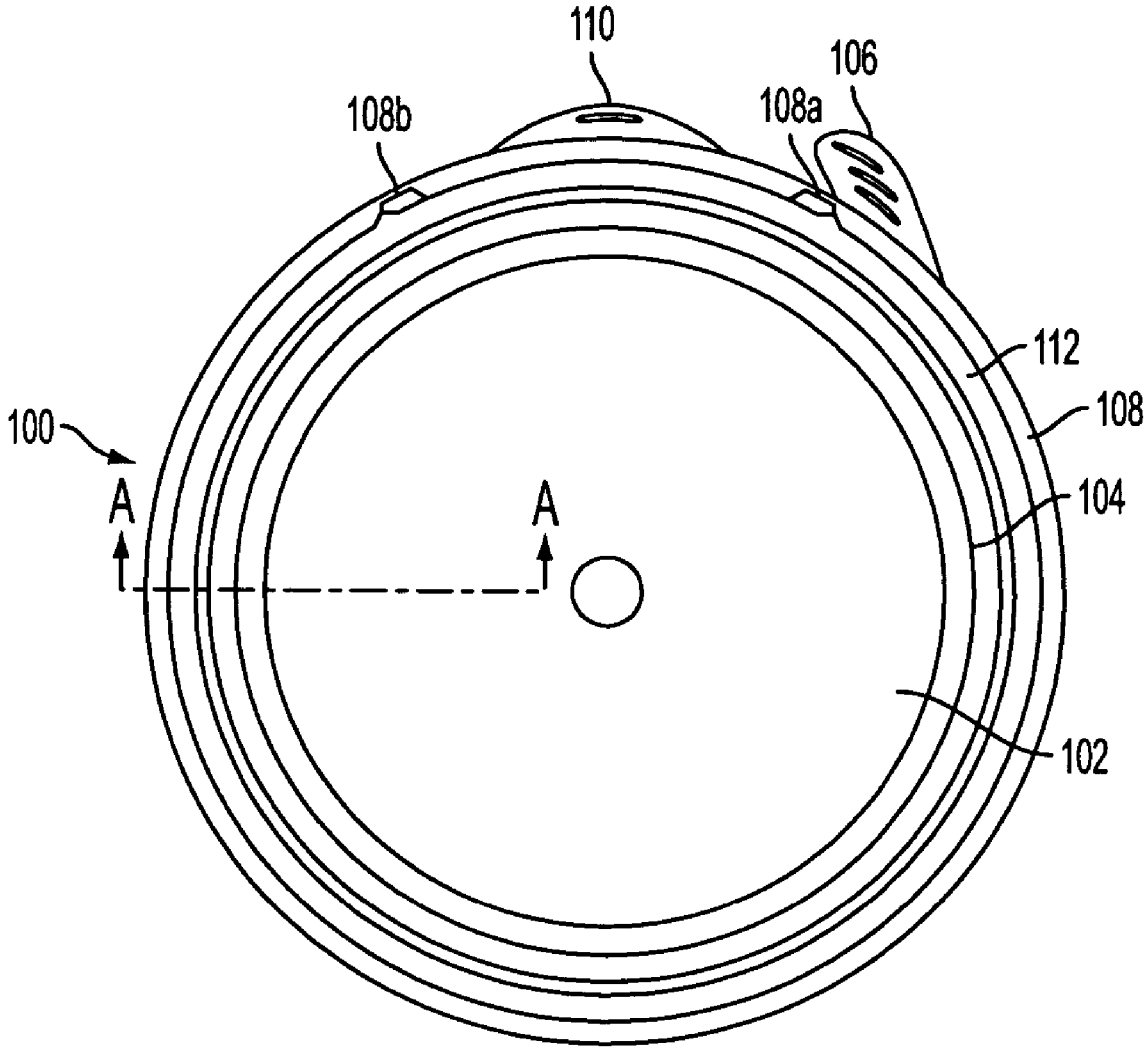
FIG. 1 is a top plan view of the closure according to the present invention.
Figure 2A:
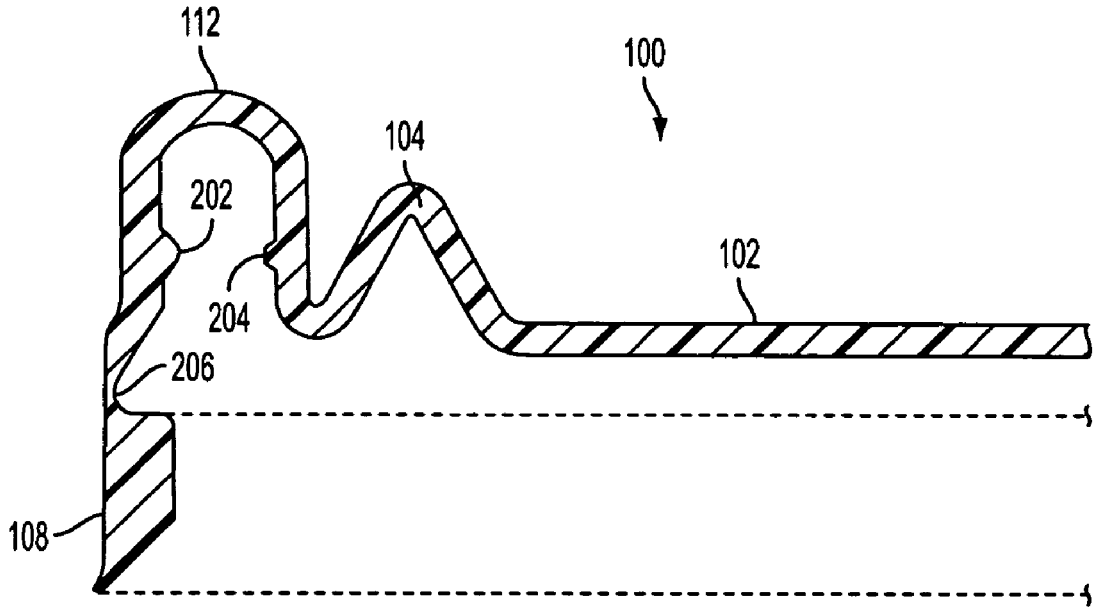
FIG. 2A is a cross-sectional view taken along the line A—A of FIG. 1.

As can be seen from FIGS. 1 and 2A, a lid 100 according to the present invention is substantially circular and has a substantially planar center region 102. A spring 104 surrounds the center region 102. The spring 104 in the illustrated embodiment is an annular formation that bends in one direction out of the plane defined by the center region 102 and then bends back. The lid 100 also has a pull-tab 106 to remove a tamper-evident seal 108 clockwise from a break point 108*a* to a breakpoint 108*b*. In the illustrated embodiment, the seal 108 is a band that extends annularly around the lid 100 and a container that the lid covers. A push-up tab 110 remains on the lid 100 after the tamper-evident seal 108 is removed, allowing the user to push the lid up and remove it from the container. The lid 100 also includes an arcuate flange receiving portion 112 near the perimeter of the lid 100 to receive the flange of a container.

As can be seen from FIG. 2A, the flange receiving portion 112 includes a primary bead 202 on an outer wall and a secondary bead 204 on an inner wall. An annular locking ridge undercut 206 on an inner surface of the outer wall of the flange receiving portion 112, below the secondary bead 202, accepts a locking ridge on a container, forming a seal with the container while the tamper-evident seal 108 is still in place. The locking ridge undercut 206 defines a narrowing of the material in the outer wall of the flange receiving portion 112 that is the tear line for the removal of the tamper evident band 108. The secondary bead 204 acts as a secondary seal, as described below. The primary bead 202 latches into a container flange to form a primary seal.

Figure 2B:
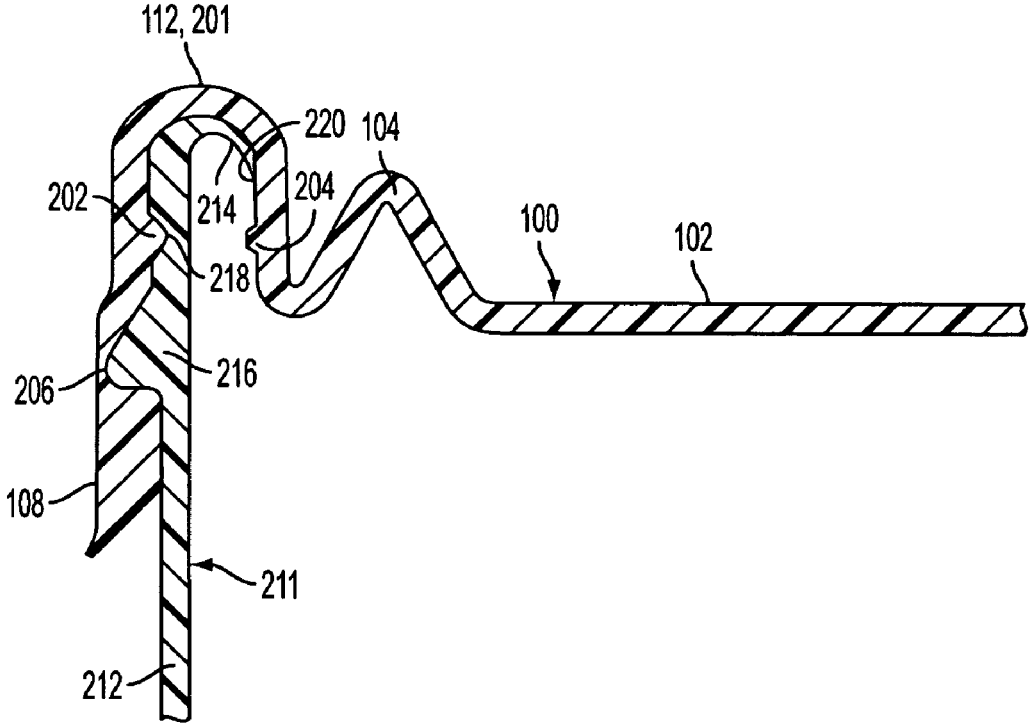
FIG. 2B is a cross-sectional view of a wall of a container with the lid of FIG. 2A in place.

As can be seen from FIG. 2B, a container 211 has a sidewall 212 extending into the flange receiving portion 112 of lid 100 and terminating in a tapered inwardly curving flange 214. The flange 214 has an upper face that is finished smooth, by means of well-known finish equipment, such as a reamer, the flange tapering to a free edge 220. An annular locking ridge 216 projects outward from the sidewall 212, slightly below the flange 214 and fits into the undercut 206 in the lid 100. For this purpose, the locking ridge 216 has a shape complementary to the shape of the undercut 206. The primary bead 202 of the lid 100 fits into a groove 218 formed in an outer surface of the container sidewall 212, between the flange 214 and the locking ridge 216, the top of the groove 218 defining the lower end of the flange 214. After removal of the tamper evident band 108, the primary seal preventing loss of liquid from the container 100 is formed by the interaction of the primary bead 202 of the lid with the groove 218 of the container side wall. For this purpose, the shapes of the primary bead 202 and the groove 218 are complementary to one another. A secondary seal is formed by the interaction of the flange free edge 220 with the flange receiving portion 112. The secondary bead 204 catches the free edge 220 of the container flange 214 when the container is dropped or otherwise acted on in a manner tending to dislodge the lid 100, and thus prevents the dislodging of the lid from impact pressures on the container. The secondary bead 204 also interacts with the flange 214 to maintain a seal. If the container flange 214 becomes deformed, for example, when the container is dropped, the flange is prevented from curving too far inwardly by bead 204, thus preserving the secondary seal.

The spring 104 provides a radial braising force in the lid 100 and enables the center 102 of the lid to float from one side to the other to accommodate the variation of the length of the flange 214 on the container. The spring 104 applies a constant pressure at all 360 degrees around the container, and enables the lid 100 to be resealed. In particular, the spring 104 applies radial pressure to secondary bead 204, providing a secondary seal that increases drop test performance. The spring 104 also applies an outward force on the flange receptacle 112, acting to maintain contact between the inner wall of the flange receptacle and the flange 214.

As can be appreciated from FIGS. 1–5, the lid 100 provides a means of closing the open end of the container 211, and provides an initial tamper resistant seal, and a reusable seal once the tamper resistant seal is removed.

Figure 3:
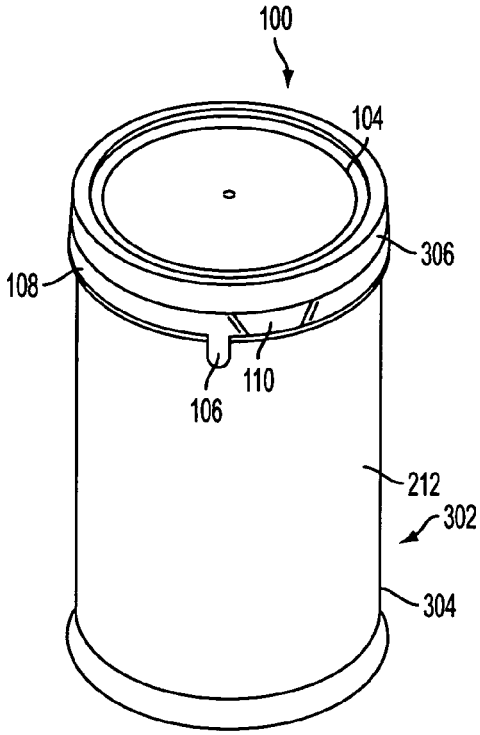
FIG. 3 is a perspective view of a container with a lid embodying the present invention.
Figure 4:
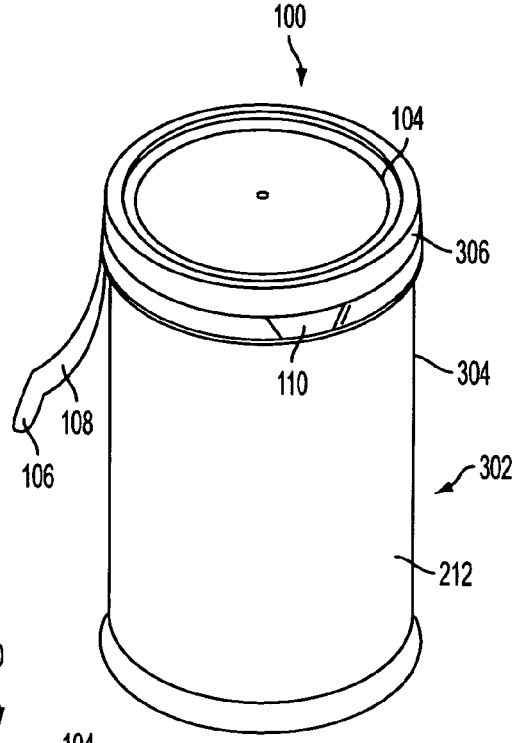
FIG. 4 is a perspective view of the container and lid of FIG. 3, with a tear strip partially removed from the lid.
Figure 5:
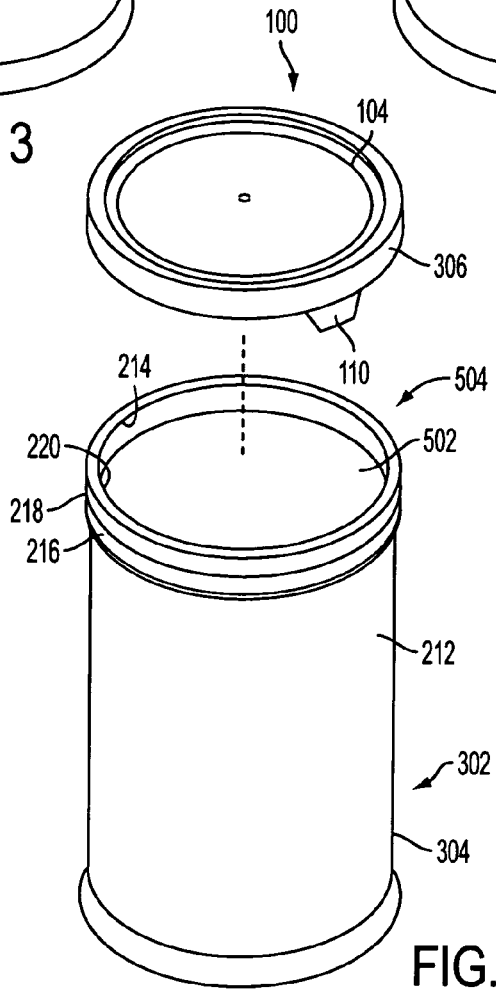
FIG. 5 is an exploded perspective view of the container and lid of FIG. 4, with the tear strip entirely removed.

To this end, the container 302 has a wide mouth circular open end 504. As seen in FIG. 3, the container 302 has an outer periphery 304, which is of a generally constant diameter throughout the length of the container 302. The container 302 has an inner periphery 502, which also has a generally constant diameter throughout the length of the container 302. The thickness of the sidewall 208 of the container 302 is kept as thin as possible to minimize the quantity of plastic required to manufacture the container 302. The container 302 has an inturned sealing flange 214 directly adjacent to its open end 504. The portion of the flange adjacent to the free edge 220 is flexible and thereby aids in providing a significant line of sealing engagement between the container 302 and the lid 100.

The skirt 306 of the lid 100 girds the outer periphery 304 of the container 302, extending there along from the open mouth, or end, 504. The skirt 306 is provided with a reduced thickness line, corresponding to undercut 206, providing a tearable means defining a tear strip 108 which extends substantially about the outer periphery 304 of the container open end 504. The tear strip 108 has a pull-tab 106 which projects from the outer skirt 306. The pull-tab 106 is designed to be grasped by the consumer to remove the tear strip 210 by pulling on it in a circular fashion about the container in a well-known manner. As in currently available lids, the present invention contemplates break points that define the extent of tamper evident band removal. The portion of the skirt 306 that does not form the tear strip 108 remains to form a push-up tab 110. The push-up tab 110 is used for removing the lid 100 after the tear strip 108 has been completely removed from the lid 100 by enabling upward thumb pressure to be applied while gripping the container body.

The lid 100 can be easily removed and replaced. To this end, a locking ridge 216 is provided on the outer periphery of the container at open end 504. The locking ridge 216 extends completely around the outer periphery of the container, below the undercut 218, and fits into the undercut 206 of the skirt 306. In addition, the hairpin shape of the sealing flange provides flexure to the open end, even when frozen, to allow for easy removal of the lid and positive locking of the lid when sealed.

The embodiments discussed herein are non-limiting examples. The lid and container of the present invention may comprise material known in the art and generally used for the described applications as well as others. These materials include plastics, for example, polyethylene terephthalate (PET), low density polyethylene (LDPE), high density polyethylene (HDPE), and nylons, as well as other polyesters, polyolefins and polycarboxyamides having suitable properties for the intended application. Containers and lids may be manufactured by methods well-recognized in the art, for example blow molding, injection molding and extrusion blow molding. U.S. Pat. No. 4,933,133, incorporated herein by reference in its entirety, provides a particular method of manufacture.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents. For example, although a circular lid has been illustrated herein, the present invention also applies to lids having other shapes.

What is claimed is:

1. A leak-resistant closure for a plastic container having an inwardly curving container flange extending from a sidewall and around an inner periphery at an open end and terminating in a free edge, said closure comprising:

a generally planar central portion;

a peripheral portion for receiving the open end of the container, said peripheral portion defining an annular recess opening in a direction generally perpendicular to the generally planar central portion and comprising an inner wall having a secondary sealing formation on an outer surface thereof and facing said annular recess, and an outer wall having a primary sealing formation on an inner surface thereof and facing said annular recess thereby defining the primary sealing formation for engaging a complementary sealing formation on the container to form the primary seal therewith within said annular recess; and a spring structure biasing the peripheral portion radially outward from the central portion, the spring structure being positioned between the central portion and the peripheral portion, wherein the secondary sealing formation is spaced from the free edge when the primary sealing formation is engaged with the complementary sealing formation, and the secondary sealing formation engages the free end after disengagement of the primary sealing formation from the complementary sealing formation.

2. The leak-resistant plastic closure of claim 1, wherein the spring structure comprises an annular fold in the lid.

3. The leak-resistant plastic closure of claim 2, wherein the lid is made of a resilient plastic.

4. The leak-resistant plastic closure of claim 2, wherein the annular fold is positioned adjacent to the peripheral portion.

5. The leak-resistant closure of claim 1, wherein the secondary sealing formation is an annular bead projecting into the annular recess.

6. The leak-resistant closure of claim 1, wherein the primary sealing formation is an annular bead projecting into the annular recess.

7. The leak-resistant closure of claim 1, wherein the annular recess has a closed end, and the inner surface of the outer wall has a locking recess for receiving a complementary formation, the locking recess being positioned further from the closed end of the annular recess than the primary sealing formation is.

8. The leak-resistant closure of claim 7, wherein the locking recess has a lower surface lying in a plane substantially perpendicular to the inner surface of the outer wall.

9. The leak-resistant closure of claim 7, wherein the outer wall has a skirt portion lying on a side of the locking recess opposite to a side of the locking recess on which the closed end of the annular recess lies, the skirt portion defining a tamper evident band, and the locking recess defining a tear line for the tamper evident band.

10. The leak-resistant plastic closure of claim 9, further comprising: at least two break points in said tamper-evident band; and a push-up tab being defined by the skirt portion between said break points.

* * * * *